US011795040B2

(12) United States Patent
Eberhardt

(10) Patent No.: US 11,795,040 B2
(45) Date of Patent: Oct. 24, 2023

(54) BALLAST DEVICE AND MOBILE CRANE HAVING SAME

(71) Applicant: Liebherr-Werk Ehingen GmbH, Ehingen/Donau (DE)

(72) Inventor: Lars Eberhardt, Staig (DE)

(73) Assignee: Liebherr-Werk Ehingen GmbH, Ehingen/Donau (DE)

( * ) Notice: Subject to any disclaimer, the term of this patent is extended or adjusted under 35 U.S.C. 154(b) by 123 days.

(21) Appl. No.: 17/447,688

(22) Filed: Sep. 14, 2021

(65) Prior Publication Data

US 2022/0081264 A1 Mar. 17, 2022

(30) Foreign Application Priority Data

Sep. 14, 2020 (DE) ..... 102020123821.5

(51) Int. Cl.
*B66C 23/74* (2006.01)

(52) U.S. Cl.
CPC ..... *B66C 23/74* (2013.01)

(58) Field of Classification Search
CPC ..... B66C 23/72; B66C 23/74; B66C 23/76; E02F 9/18
See application file for complete search history.

(56) References Cited

U.S. PATENT DOCUMENTS 5,615,784 A * 4/1997 Pech ..... B66C 23/74 104/306
2005/0284834 A1* 12/2005 Willim ..... B66C 23/74 212/178
2010/0224583 A1* 9/2010 Mentink ..... B66C 23/74 212/175

FOREIGN PATENT DOCUMENTS

CN 106144923 A 11/2016
DE 202007007307 U1 12/2007

* cited by examiner

*Primary Examiner* — Sang K Kim
*Assistant Examiner* — Nathaniel L Adams
(74) *Attorney, Agent, or Firm* — McCoy Russell LLP

(57) ABSTRACT

The disclosure relates to a ballast device for fastening to a crane having first and second ballast elements. The first ballast element has first connection means for a releasable fastening to the crane, while both ballast elements are releasably connected to one another via second connection means. According to the disclosure, the first ballast element comprises an assembly device having abutment elements to which an abutment means can be attached to raise the ballast device. The abutment elements are arranged or are positionable such that the abutment means can be selectively attached to the assembly device for raising only the first ballast element above its center of gravity or for commonly raising both ballast elements above their total center of gravity. The disclosure further relates to a mobile crane having at least one such ballast device.

20 Claims, 6 Drawing Sheets

BALLAST DEVICE AND MOBILE CRANE HAVING SAME

CROSS REFERENCE TO RELATED APPLICATIONS

The present application claims priority to German Patent Application No. 10 2020 123 821.5 filed on Sep. 14, 2020. The entire contents of the above-listed application is hereby incorporated by reference for all purposes.

TECHNICAL FIELD

The present disclosure relates to a ballast device for fastening to a crane such as the superstructure of a mobile crane, and to a mobile crane having such a ballast device.

BACKGROUND

Travelable cranes or mobile cranes are typically always used when no stationary cranes are available at the deployment site or if they cannot be used for other reasons or only with an increased effort. Mobile cranes having a wheeled chassis are driven in public road traffic in this respect and are therefore subject to the regulations that apply there with respect to maximum axle loads and permitted dimensions. Smaller cranes are frequently used as so-called taxi cranes and carry all their equipment objects for use on the construction site along with them, also in public road traffic. Larger mobile cranes are, however, not able to do this so that it is necessary to dismantle crane components for transport in public road traffic and to assemble them on site.

SUMMARY

The ballast is a crane component with a high weight of its own so that it appears sensible to remove it from the mobile crane for road transport. It can also be mounted, i.e. attached to the mobile crane ready for work, very quickly and independently at the deployment site. The removed crane ballast is typically transported to the deployment site by a separate vehicle. The approach to the ballast or to the components/ballast elements forming the crane ballast is thus not to optimize toward the transport conditions at the mobile crane, but rather toward the separate transport as a transported product and toward the actual crane deployment.

FIGS. 1*a* and 1*b* show an example of a larger mobile crane 1 that is known from the prior art and whose superstructure ballast is to be removed for road transport. The mobile crane 1 has an undercarriage 2 having a multiaxial wheeled chassis, a superstructure 3 rotatably supported about a vertical axis on the undercarriage 2, a telescopic boom 4 pivotably supported at the superstructure 3 and luffable via a luffing ram 7, and a superstructure ballast supported at the rear of the superstructure 3. Said superstructure ballast comprises a ballast mounting apparatus or ballast support plate 5 that can be attached to the superstructure 3 on which the plurality of ballast plates 6 can be stacked.

The ballast support plate 5 is placed onto an intended position at the rear of the undercarriage 2 via the telescopic boom 4 and the individual ballast plates 6 are stacked up for the independent mounting of the ballast. The maximum stack height is limited here by the ballasting device or by the superstructure 3 and the placement height on the undercarriage 2. To mount a larger ballast mass on the superstructure 3, there is the possibility of laterally attaching a suspension ballast 9 to the ballast or to the ballast stacks. However, a deployment-oriented ballast setup also has to be provided here. In the solution shown in FIGS. 1*a-b*, two ballast elements forming a suspension ballast 9 can be respectively attached to the left and to the right of the central ballast stacks. This type of suspension ballast 9 can also be called a double suspension ballast. A respective first ballast element is here hooked to the stacked ballast and the second ballast element is hooked to the first ballast element. More than two ballast elements could naturally also be attached in this manner.

Each of the two ballast elements can be hooked into corresponding recesses of the mating piece from above with shape matching via a kind of dovetail. The respective elements are then held securely in position by gravity. To separate the two ballast elements, the crane raises the outer ballast element and guides it out of the connection, The respective ballast element must be taken up above its center of gravity for an independent orientation for the mounting or dismantling. With the kind of setup known from the prior art, each ballast element can, however, only be taken up individually, via laterally arranged bollards as a rule, since the total center of gravity of the two mutually connected ballast elements is within the outer ballast element. An abutment at the outer ballast element would thus be necessary for an independent orientation, which would, however, release the shaped matched suspension connection of the two ballast elements.

For this reasons, two lifts have previously been required on each side (i.e. to the left and to the right of the ballast stack) for the mounting of the double suspension ballast—one lift each for the inner and outer ballast elements. This additional work is not only time consuming and thus cost-intensive, but also increases the risk of accidents during mounting since work has to be carried out on the connections disposed further outwardly from the base on the ballast stack on the fastening of the outer ballast elements.

It is therefore the object of the present disclosure to simplify the previously described ballasting procedure.

This object may be achieved in accordance with the disclosure by a ballast device. A ballast device for fastening to a crane, such as the superstructure of a mobile crane, is accordingly proposed that comprises a first ballast element and a second ballast element. The first ballast element here has first connection means for a releasable fastening to the crane, while both ballast elements may be releasably connected to one another via second connection means.

In accordance with certain embodiments of the disclosure, the first ballast element comprises an assembly device having abutment elements to which an abutment means can be attached to raise the ballast device. In this respect, the abutment elements are arranged or are positionable such that the abutment means can be selectively attached to the assembly device for the raising of only the first ballast element above its center of gravity or for a common raising of both ballast elements above their total center of gravity.

A possibility is therefore now provided by the present disclosure of raising and assembling both ballast elements in a secure and simple manner. Since one abutment point is above the total center of gravity, the packet of the connected ballast elements orients itself independently. The number of required lifts is thereby reduced, i.e. on a use as a double suspension ballast on both sides of the regular ballast stack at the superstructure halved from four to two. Only the first ballast elements can also selectively be attached, with here corresponding abutment elements also being available that ensure an automatic orientation.

The abutment points enabling the single lift (only the first ballast element) and the total lift (both ballast elements together) may be implemented by different abutment elements spaced apart from one another. Alternatively, however, provision can also be made that the same abutment elements can be used for both the single lift and the total lift, with the abutment elements then having to be movable between the positions above the corresponding centers of gravity (for example by extension and retraction, folding, pivoting, etc. of corresponding components of the assembly device comprising the abutment elements).

Since the two ballast elements can already be attached together in the connected state, the required worksteps are transposed further inwardly toward the base on the ballast stack. A reduction of the risk of accident is thereby also achieved in addition to a simplification of the ballasting procedure.

Provision is made in an embodiment that the assembly device has first abutment elements for raising only the first ballast element and second abutment elements for a common raising of both ballast elements, with the distance between the first and second abutment elements corresponding to the distance between the center of gravity of the first ballast element and the total center of gravity of the mutually connected ballast elements.

Provision is made in a further embodiment that the first abutment elements are arranged above the center of gravity of the first ballast element and the second abutment elements are arranged in an assembly position of the assembly device above the total center of gravity of the mutually connected ballast elements. The assembly device can therefore be moved from a parked position which the second abutment elements are not disposed above the total center of gravity into an assembly position. The assembly device can, for example, be supported in a space saving manner at the ballast device in the parked position. In certain embodiments, the first abutment elements for a single lift do not have to be separately moved into an assembly position. In other embodiments, both the first and second abutment elements are movable together or individually in each case between a parked position and an assembly position.

Provision is made in a further embodiment that the first and/or second connection means are means for establishing a suspension connection. In other words, the ballast elements are suspension ballast or suspension ballast elements. The first ballast element can here be hooked into corresponding mounts at the ballast mounting apparatus or into ballast elements supported on the ballast mounting apparatus. If required, the second ballast element can be hooked into the first ballast element via the second connection means. The connection means can be configured in a known manner as noses or projections and corresponding mounts, such as to form a dovetail connection or a similar connection.

Provision is made in a further embodiment that the assembly device is an inseparable component of the first ballast element, i.e. always remains at the first ballast element and is not removed for transport or during mounting. The assembly device may be movable relative to the first ballast element, for example, to be able to move it to and fro between a parked position and an assembly position.

Provision is made in a further embodiment that the ballast elements are configured such that the total center of gravity of the mutually connected ballast elements lies within the second ballast element. The two ballast elements can generally be identically or differently shaped.

Provision is made in a further embodiment that the assembly device comprises an elongate and, in certain embodiments, cylindrical part and a head part arranged at an end of the elongate part, with the head part comprising the abutment elements and being rotatable and/or foldable and/or telescopic or displaceable relative to the first ballast element. First and second abutment elements to which the abutment means is selectively attached for a single lift or for a total lift can be arranged at the head part. It can be necessary here to move the first and/or second abutment elements from a parked position into an assembly position by rotating, folding, and/or displacing the head part, individual components thereof, or the total assembly device. Alternatively, the same abutment elements can be used for the single lift and the total lift, with them then having to be positioned correspondingly relative to the first ballast element or its center of gravity.

Provision is made in a further embodiment that the head part is configured as an arm projecting from the elongate part, with the first abutment elements being arranged in the region of the elongate part and the second abutment elements being arranged at the opposite end of the arm. The second abutment elements can be positioned above the total center of gravity, for example by a rotation of the arm, and a total lift can thus be made possible. The position of the first abutment elements does not change on such a rotation due to their positioning in the region of the elongate part so that they always remain substantially above the center of gravity of the first ballast element.

Provision is made in a further embodiment that the first ballast element has a guide channel in which the elongate part of the assembly device is displaceably supported along its longitudinal axis and, in some embodiments, rotatably about the longitudinal axis. The guide of the elongate part can here be formed, for example, by a continuous bore or by a channel or by a plurality of spaced apart guides. The guide channel can extend through the total ballast element or can end within the ballast element.

Provision is made in a further embodiment that the first ballast element has a first recess at the upper side in which the head part of the assembly device can be completely brought or lowered in a parked position. In the parked position, no region or part of the assembly device or of the head part projects beyond the first ballast element so that no additional space is taken up and the assembly device is completely protected. Provision can be made that the pulled assembly device lowers independently due to gravity until the head part or another abutment abuts the first recess or another counter-abutment.

Provision is made in a further embodiment that the assembly device has an abutment that upwardly bounds a displacement of the assembly device relative to the first ballast element in cooperation with a counter-abutment provided at or in the first ballast element. The assembly device can thereby be pulled out of the first ballast element or of the guide channel up to a defined height. In certain embodiments, the abutment can be arranged at the end of the elongate part disposed opposite the head part.

Provision is made in a further embodiment that the first ballast element has a second recess whose upper boundary or upper side forms the counter-abutment for the abutment of the assembly device. I.e. the abutment moves upward for so long until it abuts the upper side of the second recess and the assembly device is thus extended to a maximum. The abutment and the second recess furthermore each have at least two lateral abutments and counter-abutments that cooperate in the azimuthal direction and that limit a rotation about the longitudinal axis to a certain angular range in the maximally extended position of the assembly device.

The designation "cooperate in the azimuthal direction" here means that the lateral abutments and counter-abutments abut one another at a specific angle on a rotation of the assembly device about the longitudinal axis of the elongate part. At least two pairs of lateral abutments and counter-abutments here bound the rotational range of the assembly device to a certain finite angular range. More than two lateral abutments can, however, also be provided, for example when the abutment is configured as a pin projecting from the elongate part at both sides or as a triangular plate and two respective pairs of lateral abutments and counter-abutments are therefore provided per pin or per side of the plate.

The assembly device can be in the assembly position in which an abutment point may be available above the total center of gravity of both ballast elements on the abutment of the abutment at the counter-abutment, i.e. when it is maximally extended, and on the abutment of a lateral abutment at a lateral counter-abutment, that is in a maximum angular position. The assembly device is therefore moved from the lower parked position into the assembly position, and vice versa, such as by raising or extending and rotating.

Provision is made in a further embodiment that the abutment is configured as a pin projecting laterally from the elongate part or as a plate. The pin can project from the elongate part at one side or at both sides. On a configuration as a plate, the latter can have a polygonal form, such as the form of an equilateral triangle. The second recess may furthermore formed at the lower side of the first ballast element, i.e. open to the bottom, or it may be completely surrounded and in the lower region.

Provision is made in a further embodiment that the assembly device has a latching mechanism in which it is releasably latchable in an assembly position. The assembly device can thereby be locked in the assembly position so that the connected ballast elements can be reliably raised. In certain embodiments, the latching mechanism comprises a latching element supported at the head part, such as a latching pin that is pressed into a cutout of the first ballast element by a spring element in the assembly position. The latching mechanism thereby latches automatically as soon as the assembly position has been reached.

The latching mechanism can comprise a lever element or a handle by whose actuation the latching connection is releasable so that the assembly device can be moved out of the assembly position again. An indicator element can furthermore be provided that can also be formed by the lever element/the handle itself and that visually indicates to the operator that the assembly device is in the assembly position. This can be achieved, for example, in that the indicator element points to a specific element attached to the ballast element, e.g. a component, a cutout, a marking, or the like, in the assembly position.

The present disclosure further relates to a mobile crane having an undercarriage, a superstructure rotatably supported on the undercarriage, a ballast mounting apparatus arranged at the superstructure or couplable thereto for mounting a crane ballast, and at least one ballast device in accordance with the disclosure that is releasably fastenable, e.g., hookable, to the ballast mounting apparatus and/or to a ballast element placed or stacked thereon. In this respect, the same properties obviously result as for the ballast device in accordance with the disclosure so that a repeat description will be dispensed with at this point.

BRIEF DESCRIPTION OF THE FIGURES

Further features and details of the disclosure result from the embodiments explained in the following with reference to the Figures. There are shown.

DETAILED DESCRIPTION

Figure 1A:
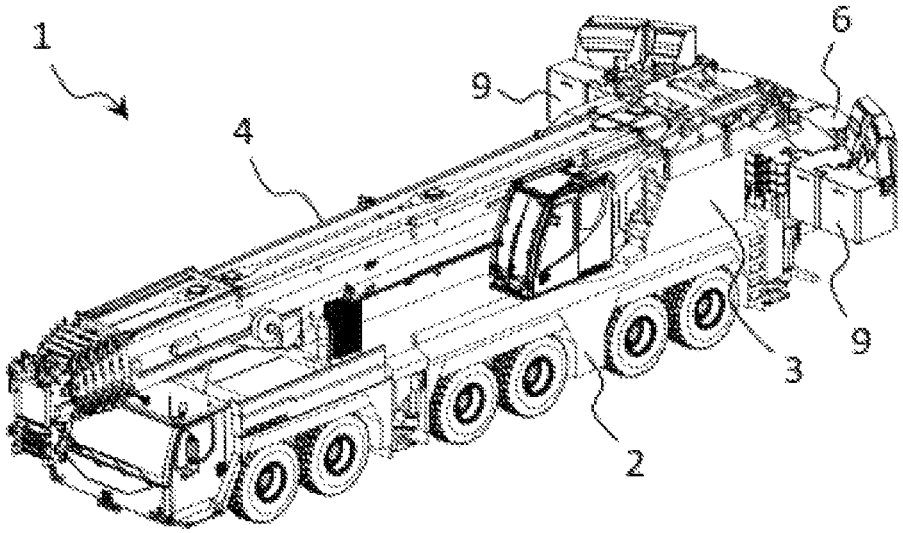
Fig. 1a (Prior Art)
FIGS. 1*a-b*: perspective views of an embodiment of a mobile crane known from the prior art.
Figure 1B:
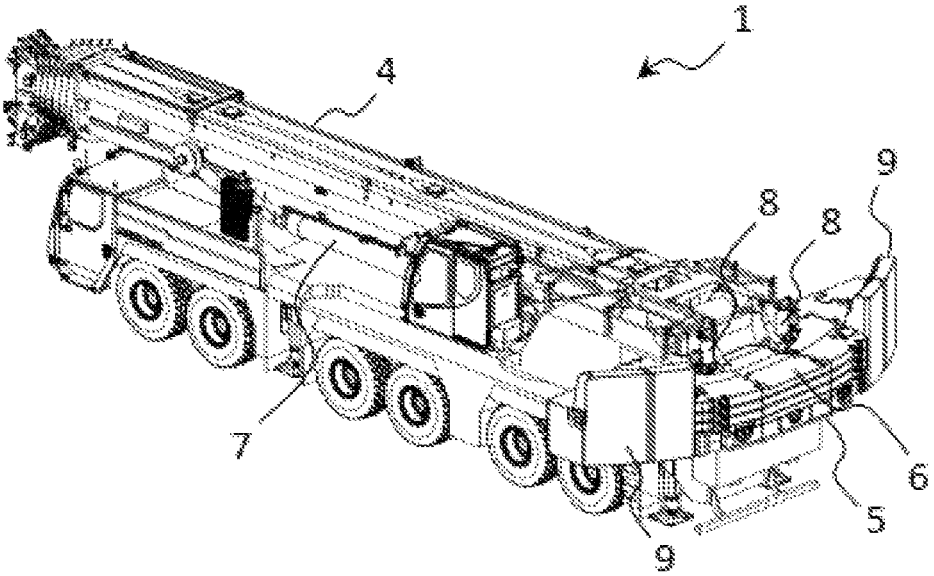
Fig. 1b (Prior Art)

FIGS. 1*a* and 1*b* show two views of a mobile crane 1 that is known from the prior art and that has already been initially explained in detail. A repeat description is therefore dispensed with here. It must, however, generally be noted that the ballast device in accordance with the disclosure can also be used with other cranes, for example with mobile cranes having a crawler chassis.

Figure 2:
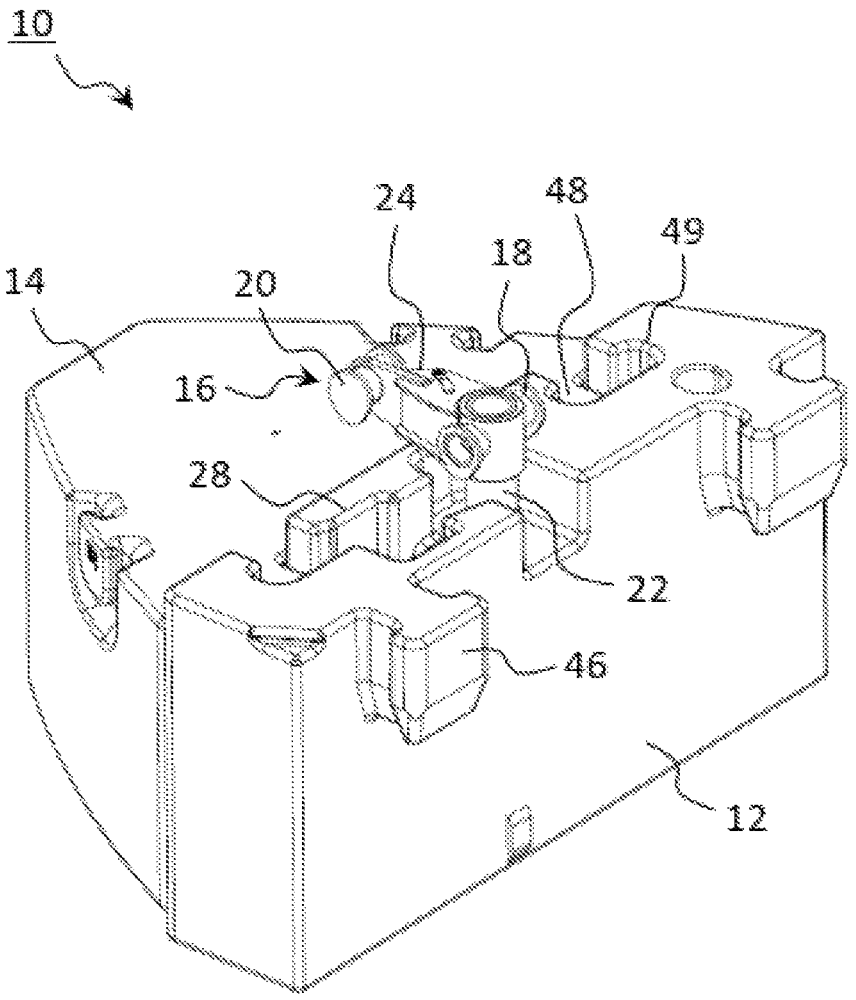
FIG. 2: the ballast device in accordance with the disclosure in accordance with an embodiment in a perspective view.

An embodiment of the ballast device 10 in accordance with the disclosure is perspectively shown in FIG. 2 that can be attached, like the suspension ballast 9 shown in FIGS. 1*a-b*, laterally to the superstructure ballast of a mobile crane 1 or to the ballast plates 6 forming it. The ballast device 10 in accordance with the disclosure thus represents a double suspension ballast.

The ballast device 10 in accordance with the disclosure comprises a first ballast element 12 that can be hooked to the superstructure ballast of a mobile crane 1 from above via first connection means 46 configured as projections. For this purpose, for example, the ballast plates 6 supported on the ballast mounting apparatus 5 have mounts 47 for forming shape-matched dovetail connections. Alternatively or additionally, such mounts 47 can be directly provided at the ballast mounting apparatus 5. The ballast device 10 furthermore comprises a second ballast element 14 that can be hooked into the first ballast element 12 from above. For this purpose, the ballast elements 12, 14 have corresponding second connection means 48, 49 in the form of projections 48 and mounts 49. The two ballast elements 12, 14 each held securely in position by gravity due to the suspension connections.

In the embodiment shown here, the two ballast elements 12, 14 have different shapes. Whereas the first ballast element 12 has a substantially rectangular shape in a plan view, the second ballast element 14 is substantially conically or trapezoidally shaped viewed from above. However, different shapes are naturally also conceivable here as is an identical design of the two ballast elements 12, 14.

The first ballast element 12 comprises an assembly device 16 configured as an assembly mandrel that as an element of the first ballast element 12 is not removed therefrom for transport or for mounting, but rather remains thereat. The ballast device 10 can be raised via an abutment means of the mobile crane 1 for self-mounting via a plurality of abutment elements 18, 20 arranged in the upper region of the assembly device 16.

Figure 3:
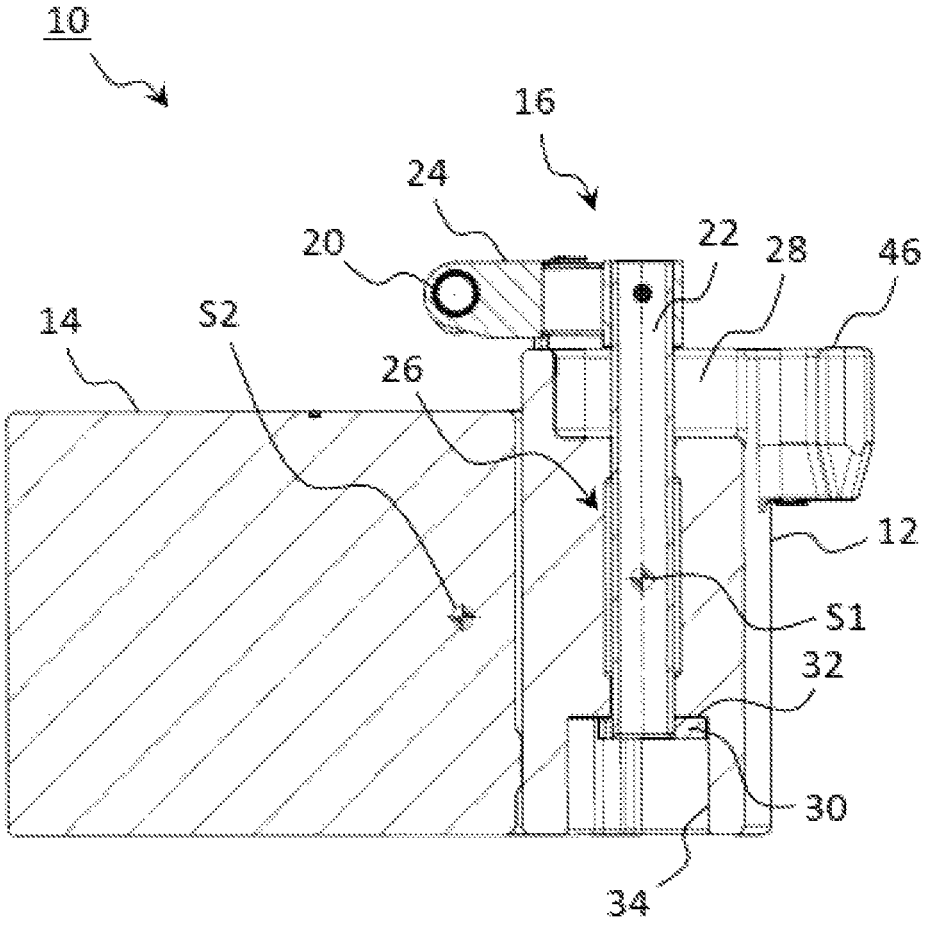
FIG. 3: a section through the ballast device in accordance with FIG. 2.

FIG. 3 shows a central vertical section through the ballast device 10 in accordance with the disclosure in accordance with FIG. 2, i.e. through both ballast elements 12, 14 and through the assembly device 16. The center of gravity S1 of the first ballast element 12 and the total center of gravity S2 of the total balance device 10, i.e. of the ballast elements 12, 14, connected to one another, are likewise drawn in FIG. 3. The total center of gravity S2 is located outside the first ballast element 12. An abutment above the center of gravity S1 is therefore not possible for a lift of the total ballast device 10 (total lift) since it would tilt. The abutment means has to be attached above the respective center of gravity S1, S2 for a stable orientation. An abutment of the abutment means at the second ballast element 14 is likewise not possible since the suspension connection of the second connection means 48, 49 would otherwise release.

Figure 6:
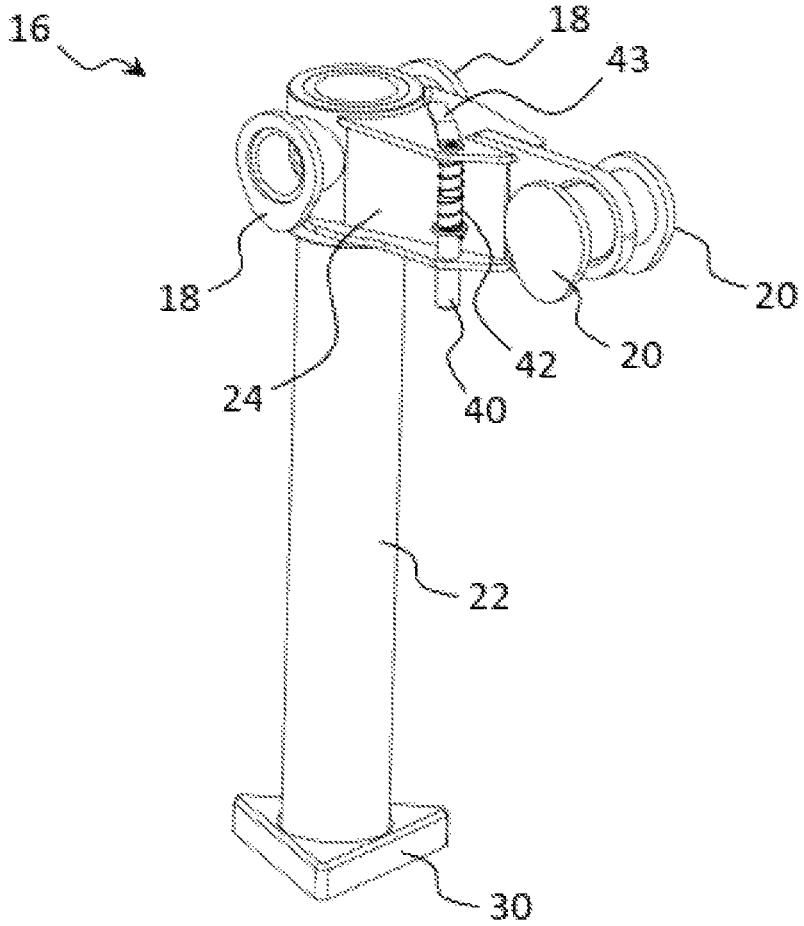
FIG. 6: the assembly device in accordance with an embodiment in a perspective view.

For this reason, the assembly device 16 has two separate and spaced apart pairs of abutment elements 18, 20 to be able to selectively lift only the first ballast element 12 or both ballast elements 12 and 14 together and to nevertheless always ensure a stable orientation. The assembly device, that is perspectively shown individually in FIG. 6, for this purpose comprises an elongate, cylindrical part 22 that is displaceably supported along its longitudinal axis and is rotatably supported about it within a guide channel 28 that is formed in the first ballast element 12 and that substantially extends through the total ballast element 12. A head part 24 is arranged at the upper end of the elongate part 22 and is formed by an arm or cantilever projecting at one side from the elongate part 22.

The head part 24 has two first abutment elements 18 in the form of laterally projecting bollards that are thus always substantially arranged above the center of gravity S1 of the first ballast element 12 in the region of the connection to the elongate part 22. The head part 24 has two second abutment elements 20 likewise projecting as lateral bollards at the end of the arm remote from the elongate part 22. The distance between the first and second abutment elements 18, 20 here corresponds to the distance between the centers of gravity S1 and S2. The second abutment elements 20 can be positioned above the total center of gravity S2 (assembly position) by rotation of the assembly device 16.

To mount the superstructure ballast of the mobile crane 1, the operator stacks the ballast plates 6 on the ballast mounting apparatus 5 placed on the undercarriage 2 as known from the prior art. If the mounting state of the mobile crane 1 requires further suspension ballast, the assembly device 16 can be removed at the different abutment elements 18, 20 depending on the demand by means of an abutment means and the telescopic boom.

On a use as a simple attachment (single lift), only the first ballast element 12 is received at the first abutment elements 18 and is connected via the projections 46 to the already stacked ballast 6 or is hooked into the corresponding mounts 47. On a use as a double suspension ballast (total lift), the packet of first and second ballast elements 12, 14 already connected via the second connection means 48, 49 is taken up at the second abutment elements 20 located in the assembly position and is connected, likewise via the projections 46 of the first ballast element 12, to the stacked ballast 6.

The first ballast element 12 has a first recess 28 at the upper side that is connected to the guide channel 28 and is open to the top. Prior to the release of the abutment means from the respective abutment elements 18, 20, the assembly device 16 or its head part 24 can be lowered in the first recess 28 (parked position) so that the assembly device 16 does not project beyond the outer contour of the first ballast element 12. In this process, the assembly device 16 lowers independently due to gravity after the release of the abutment means until the head part 24 abuts the lower side of the first recess 28. The further ballasting subsequently takes place in a known manner via the ballasting cylinders 8.

At the (lower) end disposed opposite the head part 24, the elongate part 22 has an abutment 30 that limits a pulling out of the assembly device 16 to a specific height. In the embodiment shown here, the abutment 30 is formed as a (latch) plate in the form of an equilateral triangle, with other shapes likewise being possible, for example a pin or a differently shaped plate. The guide channel 26 merges in the lower region into a second recess 34 that is open toward the lower side of the first ballast element 12 and within which the plate 30 is located. The assembly device 16 can be pulled out so far toward the top until the upper side of the plate 30 abuts the upper boundary of the second recess 34 that thereby forms a counter-abutment 32. This situation is shown in FIG. 3.

If the assembly device 16 is completely extended, the head part 24, that is now located above the upper side of the first ballast element 12, can be rotated into the assembly position. So that the second abutment elements 20 are also actually positioned above the total center of gravity S2, three lateral counter-abutments 37 are formed in the second recess 34 at which the three sides of the plate 30 abut that form corresponding lateral abutments 36 as soon as the correct assembly position has been reached. This can be recognized in FIG. 5 in which a plan view of the lower side of the first ballast element 12 is shown. A section through the first ballast element 12 and the guide channel 26 can be seen in FIG. 4, with here the assembly device 16 being lowered and the head part 24 being completely traveled into the first recess 28.

The angular position of the assembly device 16 in which the head part 24 is lowerable in the first recess 28 is defined by three further corresponding counter-abutments 37. Two pairs of counter-abutments 37 thus each define an angular range within which the assembly device 16 can be rotated about the longitudinal axis of the elongate part 22. The sides of the plate 30 and the counter-abutments 37 cooperate in the azimuthal direction. Instead of a second recess 34 open to the bottom, provision can also be made that it is formed within the first ballast element 12.

Figure 7:
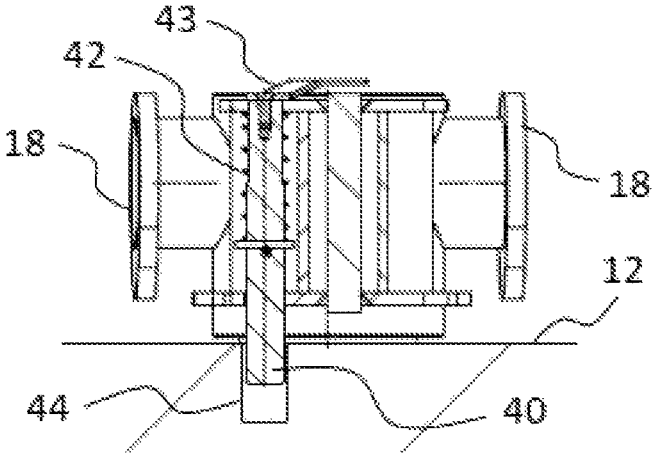
FIG. 7: a section through the head part of the assembly device in accordance with FIG. 6 latched to the first ballast element.

To fix or lock the assembly device 16 in the assembly position, a shape-matched latching connection is provided by means of a latching mechanism such as is shown with reference to an embodiment in FIG. 7 in a sectional view through the latched head part 24. The latching mechanism comprises a latching pin 40 that is held at/in the head part 24 and that is connected to a lever element or handle 34. A spring 42 adjusts the latching pin 40 back into the maximally deflected base position. A cutout 44 formed as a positioning groove is provided at the upper side of the first ballast element 12. If the latching pin 40 has latched into the positioning groove 44 via the spring 42, the second abutment elements 20 are in the correct position above the total center of gravity S2. It can hereby also be reliably recognized by the operator whether the head part is in the correct assembly position, with corresponding markings being able to be provided for better visibility.

The operator connects the first abutment means to the first abutment elements 18 for a single lift and raises the assembly device 16. The latter slides upward in the guide channel 26 until the plate 30 abuts the upper side of the second recess 34. From this moment onward, the assembly device 16 takes along the first ballast element 12 so that the latter can be attached to the remaining ballast. The head part 24 does not have to be further oriented or rotated due to the central position of the first abutment elements 18.

The operator connects the abutment means to the second abutment elements 20 for a total lift and raises the assembly device 16 off center. The latter slides upward in the guide channel 26 despite the off center abutment until the head part 24 has completely left the first recess 28. As can be recognized in FIG. 4, two guides 38 that are spaced apart sufficiently far can form the guide channel 26. The latching pin 40 has to be raised so that the operator can rotate the assembly device 16 into the assembly position (the latter is shown in FIGS. 2-3). The plate 30 rotates along until it abuts the three lateral counter-abutments 37 and is thus in the desired position. At the same time, the latching pin 40 automatically latches to the first ballast element 12 in the positioning groove 44. From this moment onward, the assembly device 16 takes along the total ballast device 10 on the raising and the double suspension ballast 10 can be attached to the remaining ballast 6.

Figure 8:
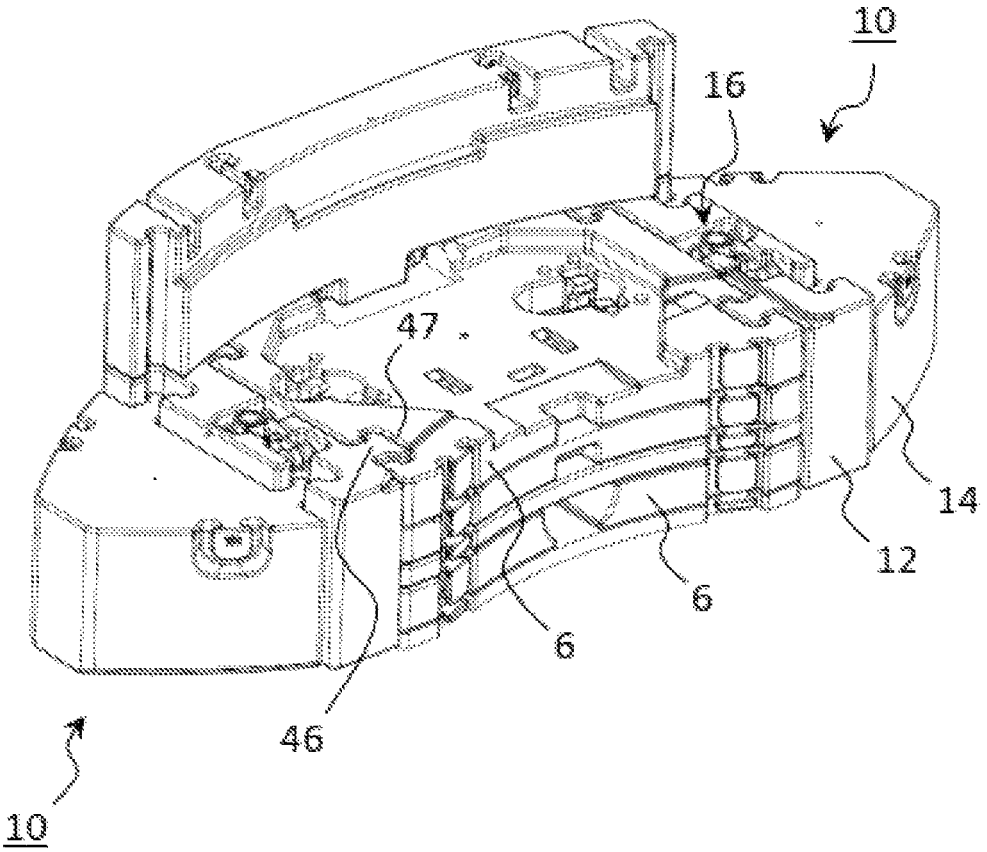
FIG. 8: a perspective view of a superstructure ballast with two laterally assembled ballast devices in accordance with the disclosure.

FIG. 8 shows two ballast stacks formed by a plurality of ballast pallets 6 as ballast devices 10 in accordance with the disclosure suspended as double suspension ballast, with the assembly devices 16 each being in their lowered parked positions.

More than two ballast elements 12, 14 can naturally also be used. For this purpose, the head 24 of the assembly device 16 has to be formed correspondingly longer or be foldable, telescopic, or otherwise adjustable so that the second abutment elements 20 are always positionable above the respective total center of gravity. It is likewise conceivable with a suspension ballast that can be assembled in modular form that further abutment elements are provided in addition to first and second abutment elements 18, 20 so that the abutment means can be attached above the respective total center of gravity depending on the configuration.

The mobile crane 1 stacks the total ballast with all the ballast elements using its own telescopic boom 4 on the intended points on the undercarriage 2. The superstructure 3 subsequently rotates its ballast mounting apparatus 5 to take up the total ballast via the ballast.

No component may project into the rotation radius of the superstructure 3 and of the ballast mounting apparatus 5 during this rotation. The high ballast elements in FIGS. 1*a* and 1*b* are further out and so do not interfere. If the assembly device 16 were to remain in the elevated position in accordance with FIG. 3, a collision would take place on the rotation of the superstructure 3.

Figure 4:
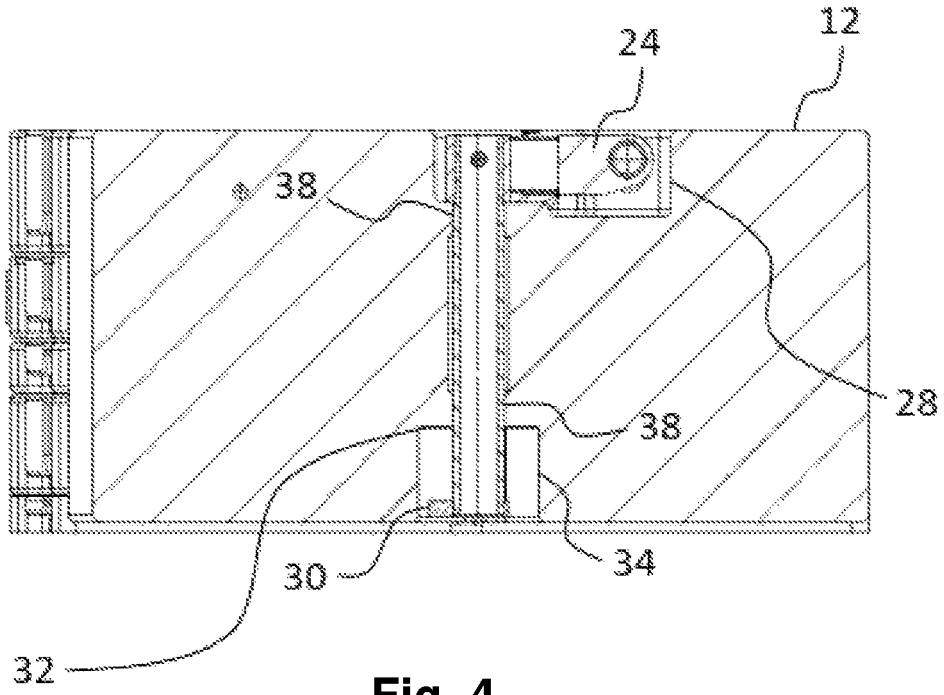
FIG. 4: a section through the first ballast element.
Figure 5:
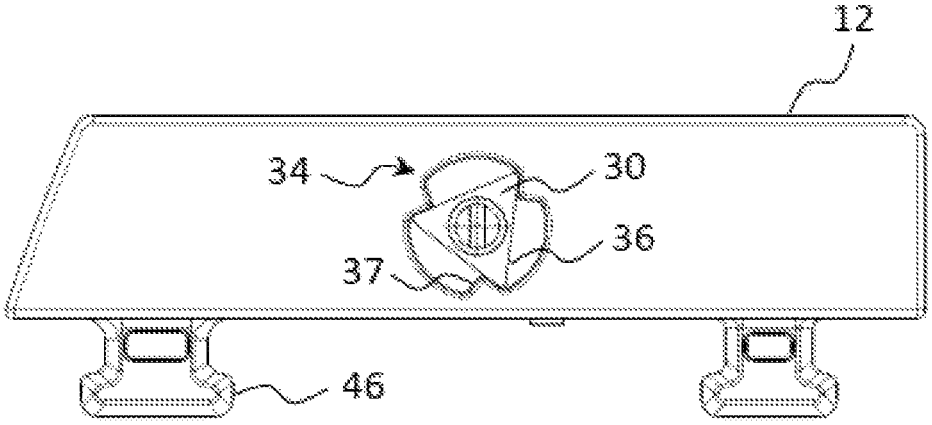
FIG. 5: the lower side of the first ballast element.

It should consequently be ensured that the assembly device 16 has been moved into its lowered position again after the hooking in of the suspension ballast (FIG. 4). This is done by a skillful selection of the upper termination of the second ballast element 14. The latter should only be so distant from the second abutment elements 20 that the load suspension means used cannot be removed. In its parked position, that is in the recess 28, so much space is provided, in contrast, that the abutment means are freely removable. FIGS. 2-8 are drawn to scale, although other relative dimensions may be used if desired.

FIGS. 2-8 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

REFERENCE NUMERAL LIST

1 mobile crane
2 undercarriage
3 superstructure
4 telescopic boom
5 ballast mounting apparatus
6 ballast plate
7 luffing ram
8 ballasting cylinder
9 suspension ballast
10 ballasting device
12 first ballast element
14 second ballast element
16 assembly device
18 first abutment elements
20 second abutment elements
22. elongate part
24 head part
26 guide channel
28 first recess
30 abutment

32 counter-abutment
34 second abutment
36 lateral abutment
38 guide
40 latching element
42 spring element
43 lever element
44 cutout
46 suspension nose (first connection means)
47 mount (first connection means)
48 suspension nose (second connection means)
49 mount (second connection means)
S1 center of gravity of the first ballast element
S2 total center of gravity of the two ballast elements

The invention claimed is:

1. A ballast device for fastening to a crane comprising a first ballast element and a second ballast element, wherein the first ballast element has first connection means for releasable fastening to the crane and wherein both ballast elements are releasably connectable to one another via second connection means, wherein the first ballast element comprises an assembly device having abutment elements to which an abutment means can be attached for raising the ballast device, with the abutment elements being arranged or being positionable such that the abutment means is selectively attachable to the assembly device for raising of only the first ballast element while gripping the first ballast element at a point above a center of gravity of the first ballast element or for common raising of both ballast elements at a further point above a total center of gravity of the mutually connected ballast elements, and the assembly device is an inseparable element of the first ballast element and is movable relative thereto.

2. The ballast device in accordance with claim 1, wherein the assembly device has first abutment elements for raising only the first ballast element and second abutment elements for the common raising of both ballast elements, with a distance between the first and second abutment elements corresponding to a horizontal distance between the center of gravity of the first ballast element and the total center of gravity of the mutually connected ballast elements.

3. The ballast device in accordance with claim 2, wherein the first abutment elements are arranged above the center of gravity of the first ballast element and the second abutment elements are arranged in an assembly position above the total center of gravity of the mutually connected ballast elements.

4. The ballast device in accordance with claim 2, wherein a head part is configured as an arm projecting from an elongate part, with the first abutment elements being arranged in a region of the elongate part and the second abutment elements being arranged at an opposite end of the arm.

5. The ballast device in accordance with claim 1, wherein the first and/or second connection means are means for establishing a suspension connection.

6. The ballast device in accordance with claim 1, wherein the first and second ballast elements are configured such that the total center of gravity of the mutually connected ballast elements lies within the second ballast element.

7. The ballast device in accordance with claim 1, wherein the assembly device comprises an elongate part and a head part arranged at an end of the elongate part, with the head part comprising the abutment elements and being rotatable and/or telescopic relative to the first ballast element.

8. The ballast device in accordance with claim 7, wherein the first ballast element has a guide channel in which the elongate part of the assembly device is displaceably supported along its longitudinal axis.

9. The ballast device in accordance with claim 8, wherein the assembly device has an abutment that limits an upward displacement of the assembly device relative to the first ballast element in cooperation with a counter-abutment provided at or in the first ballast element.

10. The ballast device in accordance with claim 9, wherein the first ballast element has a second recess whose upper boundary forms the counter-abutment for the abutment of the assembly device, with the abutment and the second recess furthermore respectively have lateral abutments or counter-abutments that cooperate in an azimuthal direction and that limit a rotation about the longitudinal axis of the elongate part to a specific angular range in an uppermost position of the assembly device.

11. The ballast device in accordance with claim 10, wherein the abutment is configured as a pin laterally projecting from the elongate part or as a plate having a polygonal shape, with the second recess being formed at a lower side or in a lower region of the first ballast element.

12. The ballast device according to claim 8, wherein the elongate part of the assembly device is rotatable about its longitudinal axis.

13. The ballast device in accordance with claim 9, wherein the abutment and counter-abutment are arranged at the end of the elongate part disposed opposite the head part.

14. The ballast device in accordance with claim 10, wherein the assembly device is located at the counter-abutment on the abutment of the abutment and at a lateral counter-abutment in an assembly position.

15. The ballast device in accordance with claim 7, wherein the first ballast element has a first recess at an upper side in which the head part can be completely lowered in a parked position.

16. The ballast device in accordance with claim 7, wherein the assembly device has a latching mechanism in which it is releasably latchable in an assembly position.

17. The ballast device according to claim 16, wherein the latching mechanism comprises a latching element that is supported at the head part and that is pressed into a cutout of the first ballast element by a spring element in the assembly position.

18. The ballast device in accordance with claim 1, wherein the ballast device can be fastened to a superstructure or to a superstructure ballast of a mobile crane.

19. A ballast device for fastening to a crane comprising a first ballast element and a second ballast element, wherein the first ballast element has first connection means for releasable fastening to the crane and wherein both ballast elements are releasably connectable to one another via second connection means, wherein the first ballast element comprises an assembly device having abutment elements to which an abutment means can be attached for raising the ballast device, with the abutment elements being arranged or being positionable such that the abutment means is selectively attachable to the assembly device for raising of only the first ballast element at a point above a center of gravity of the first ballast element or for common raising of both ballast elements at a further point above a total center of gravity of the mutually connected ballast elements, and the assembly device has first abutment elements for raising only the first ballast element and second abutment elements for the common raising of both ballast elements, with a distance between the first and second abutment elements corresponding to a horizontal distance between the center of gravity of the first ballast element and the total center of gravity of the mutually connected ballast elements.

20. A ballast device for fastening to a crane comprising a first ballast element and a second ballast element, wherein the first ballast element has first connection means for releasable fastening to the crane and wherein both ballast elements are releasably connectable to one another via second connection means, wherein the first ballast element comprises an assembly device having abutment elements to which an abutment means can be attached for raising the ballast device, with the abutment elements being arranged or being positionable such that the abutment means is selectively attachable to the assembly device for raising of only the first ballast element at a point above a center of gravity of the first ballast element or for common raising of both ballast elements at a further point above a total center of gravity of the mutually connected ballast elements, the assembly device comprises an elongate part and a head part arranged at an end of the elongate part, with the head part comprising the abutment elements and being rotatable and/or telescopic relative to the first ballast element, and the first ballast element has a first recess at an upper side in which the head part can be completely lowered in a parked position.

* * * * *